US012215293B1

(12) United States Patent
Jiang et al.

(10) Patent No.: US 12,215,293 B1
(45) Date of Patent: Feb. 4, 2025

(54) MELAMINE-BASED COMPOUNDS FOR LUBRICATING COMPOSITIONS

(71) Applicant: Afton Chemical Corporation, Richmond, VA (US)

(72) Inventors: Sheng Jiang, Glen Allen, VA (US); Kearsley Dillon, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/408,090

(22) Filed: Jan. 9, 2024

(51) Int. Cl.
*C10M 133/42* (2006.01)

(52) U.S. Cl.
CPC ..... *C10M 133/42* (2013.01); *C10M 2215/08* (2013.01); *C10M 2215/222* (2013.01); *C10M 2215/26* (2013.01)

(58) Field of Classification Search
CPC ..... C10M 133/42; C10M 2215/08; C10M 2215/222; C10M 2215/26
USPC ..... 508/257, 258
See application file for complete search history.

(56) References Cited

U.S. PATENT DOCUMENTS

| | | | | |
|---|---|---|---|---|
| 2,676,150 | A * | 4/1954 | Loughran | C10M 135/32 544/204 |
| 2,676,151 | A * | 4/1954 | Loughran | C10M 135/32 544/219 |
| 3,278,436 | A * | 10/1966 | Dazzi | C10M 133/28 508/145 |
| 6,284,717 | B1 * | 9/2001 | Crane | C07D 251/54 544/198 |
| 2005/0107268 | A1 * | 5/2005 | Negoro | C10M 111/02 508/459 |
| 2008/0274920 | A1 * | 11/2008 | Negoro | C10M 133/42 508/258 |
| 2014/0011715 | A1 * | 1/2014 | Boehn | C10M 173/02 508/513 |

* cited by examiner

*Primary Examiner* — Ellen M McAvoy
(74) *Attorney, Agent, or Firm* — Honigman LLP

(57) ABSTRACT

Melamine-based compounds suitable, in one embodiment, as a corrosion inhibitor for lubricating compositions and, in particular, a corrosion inhibitor for transmission fluids (manual, automatic, dual-clutch, or electric), axle fluids, differential fluids, tractor fluids, industrial gear fluids, and/or lubricating fluids for other gear-type applications. The melamine-based compounds are in the form of oil-soluble hydrocarbyl-substituted melamine derivatives comprising the reaction product of a hydrocarbyl-substituted succinic anhydride reacted with melamine at conditions effective to form a hydrocarbyl-substituted melamine polycarboxylic acid or anhydride compound.

21 Claims, No Drawings

MELAMINE-BASED COMPOUNDS FOR LUBRICATING COMPOSITIONS

TECHNICAL FIELD

The present disclosure relates to melamine-based compounds suitable for lubricant additives, and in particular, melamine-based compounds suitable as corrosion inhibitors and to lubricating compositions including such melamine-based compounds for achieving improved copper corrosion performance.

BACKGROUND

Transmissions (manual, automatic, dual-clutch, and/or electric), axles, differentials, and/or industrial gears commonly require lubricants that provide specific performance characteristics suitable for the desired application. Typically, lubricants for such applications may require, for example, the fluid to meet one or more performance characteristics of extreme pressure, antiwear, friction, and/or copper corrosion to suggest but a few common requirements of such fluids. Various additives may be included in the lubricant to achieve performance. For instance, such lubricants often include an oil-soluble copper corrosion inhibitor, such as a triazole, to protect metals such as copper from corrosion.

Tolyltriazole (e.g., a methyl substituted benzotriazole) is a common copper corrosion inhibitor that provides good copper corrosion performance to transmission fluids, axle fluids, differential fluids, tractor fluids, and/or industrial gear fluids to suggest a few applications that commonly include tolyltriazoles. Copper corrosion can be evaluated pursuant to ASTM D130 and/or a more extreme version of ASTM D130 by extending testing up to 168 hours at 150° C. Copper corrosion is measured through visual tarnishing ratings and/or by amounts of copper leaching in the lubricant. While tolyltriazole can provide effective corrosion inhibition with little tarnishing and low levels of copper leaching in such fluids, the use of tolyltriazole may be undesired for a number of reasons. Finding an alternative copper corrosion inhibitor providing comparable performance to tolyltriazole and being compatible with lubricant formulations for transmission fluids, axle fluids, differential fluids, tractor fluids, industrial gear fluids, and/or other gear-type applications has been challenging.

SUMMARY

In one approach or embodiment, a corrosion inhibitor in the form of an oil-soluble hydrocarbyl-substituted melamine derivative is described herein and, in aspects, has the structure of Formula I (Formula I)

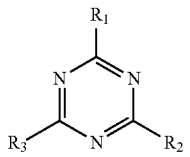

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide In other approaches or embodiments, the corrosion inhibitor of the previous paragraph includes other features or embodiments in any combination. These other features or embodiments include one or more of the following: wherein the hydrocarbyl substituent of the succinimide group or the dicarboxylic acid-amide group is a C12 to C30 hydrocarbyl group; and/or wherein the hydrocarbyl substituent of the succinimide group or the dicarboxylic acid-amide group is a C12 to a C24 hydrocarbyl group; and/or wherein the corrosion inhibitor has about 5 weight percent to about 25 weight percent of nitrogen; and/or wherein the corrosion inhibitor is a reaction product of a hydrocarbyl-substituted succinic acid or anhydride and melamine and with a molar excess of the hydrocarbyl-substituted succinic acid or anhydride relative to the melamine; and/or wherein a molar ratio of the hydrocarbyl-substituted succinic acid or anhydride to the melamine is about 1.1:1 to about 4:1; and/or wherein a molar ratio of the hydrocarbyl-substituted succinic acid or anhydride to the melamine is about 1.1:1 to about 3:1; and/or wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group; and/or wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group; and/or wherein the oil-soluble hydrocarbyl-substituted melamine derivative has one or more of the following structures

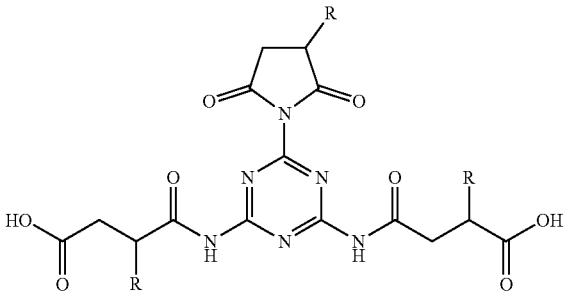

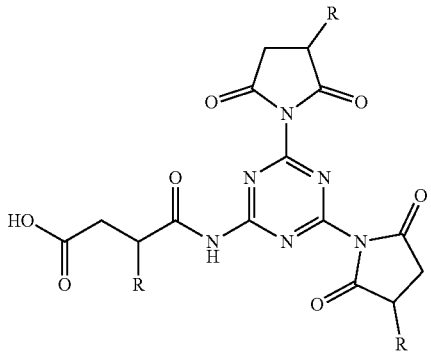

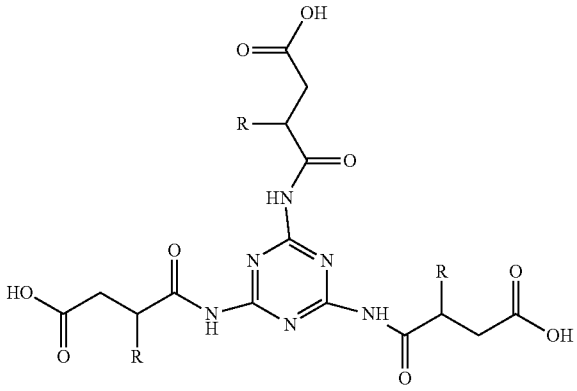

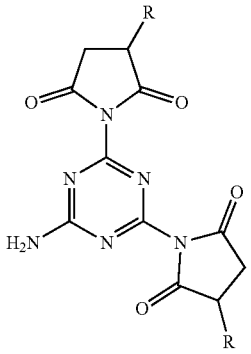

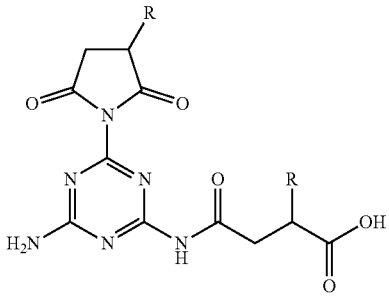

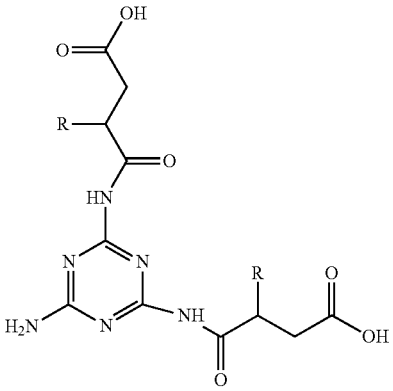

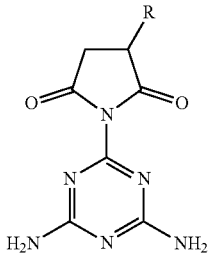

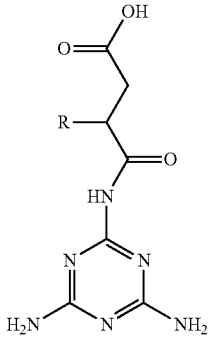

wherein each R group thereof, independently, is a C12 to C30 hydrocarbyl group; and/or wherein a lubricating composition including about 0.1 to about 0.5 weight percent of the corrosion inhibitor exhibits less than about 100 ppm of copper after testing pursuant to ASTM D130 for 168 hours at 150° C.

In another approach or embodiment, a method of preparing an oil-soluble hydrocarbyl-substituted melamine derivative corrosion inhibitor is described herein. In one aspect, the method includes reacting a hydrocarbyl-substituted succinic acid or anhydride with melamine and with a molar excess of the hydrocarbyl-substituted succinic acid or anhydride relative to the melamine.

In another approach or embodiment, the method of preparing an oil-soluble hydrocarbyl-substituted melamine derivative corrosion inhibitor of the previous paragraph includes other method steps, features, or embodiments in any combination. These other steps, features, or embodiment include one or more of the following: wherein the hydrocarbyl substituent is a C12 to C30 hydrocarbyl group; and/or wherein the hydrocarbyl substituent is a C12 to a C24 hydrocarbyl group; and/or wherein a molar ratio of the hydrocarbyl-substituted succinic acid or anhydride to the melamine is about 1.1:1 to about 4:1; and/or wherein a molar ratio of the hydrocarbyl-substituted succinic acid or anhydride to the melamine is about 1.1:1 to about 3:1; and/or wherein the formed corrosion inhibitor has about 5 to about 25 weight percent of nitrogen; and/or wherein the reaction conditions include a temperature of about 50° C. to about 200° C. (in other approaches, about 50° C. to about 150° C. or about 100° C. to about 200° C.) and a reaction time of about 1 to about 20 hours (in other approaches, about 4 to about 16 hours, and in further approaches, about 6 to about 12 hours) and/or wherein the formed oil-soluble hydrocarbyl-substituted melamine derivative has the structure of Formula I (Formula I)

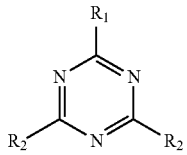

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide; and/or wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group; and/or wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group; and/or wherein the oil-soluble hydrocarbyl-substituted melamine derivative has one or more of the following structures

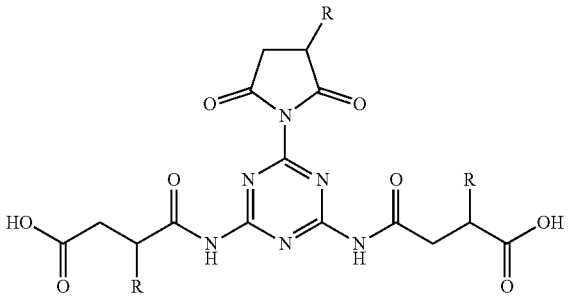

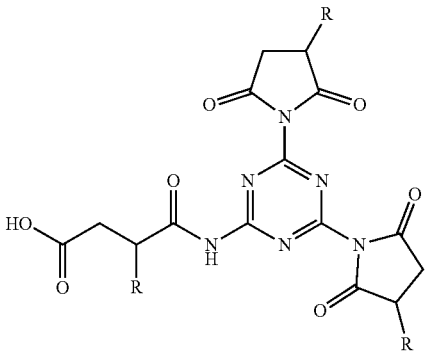

-continued

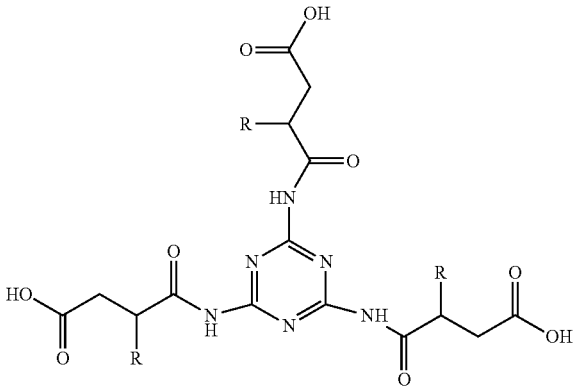

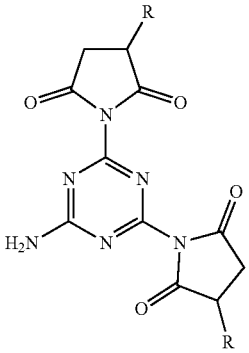

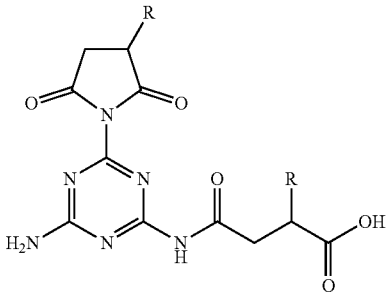

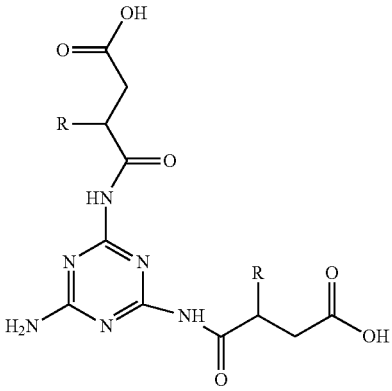

-continued

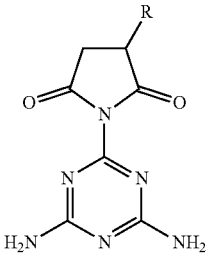

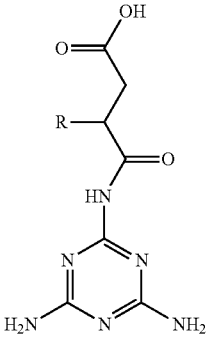

In another embodiment or approach, the present disclosure includes a driveline lubricating composition including any embodiment of the corrosion inhibitors as described above in this Summary. In one aspect, a driveline lubricating composition of this disclosure includes one or more base oils of lubricating viscosity; an oil-soluble hydrocarbyl-substituted melamine derivative having the structure of Formula I (Formula I)

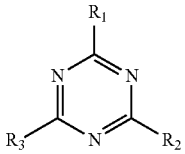

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide; and, in some embodiments, wherein the driveline lubricating composition is substantially free of tolytriazole additives or derivatives thereof (as defined further herein).

In yet other embodiments, the lubricating composition described in the previous paragraph may include one or more other features or embodiments in any combination. These other features or embodiment may include one or more of the following: wherein the hydrocarbyl substituent of the succinimide group or the dicarboxylic acid-amide group is a C12 to C30 hydrocarbyl group; and/or wherein the oil-soluble hydrocarbyl-substituted melamine derivative is a reaction product of a hydrocarbyl-substituted succinic acid or anhydride and melamine and with a molar excess of the hydrocarbyl-substituted succinic acid or anhydride relative to the melamine; and/or wherein a molar ratio of the hydrocarbyl-substituted succinic acid or anhydride to the melamine is about 1.1:1 to about 4:1; and/or wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group; and/or wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group; and/or wherein the oil-soluble hydrocarbyl-substituted melamine derivative has one or more of the following structures

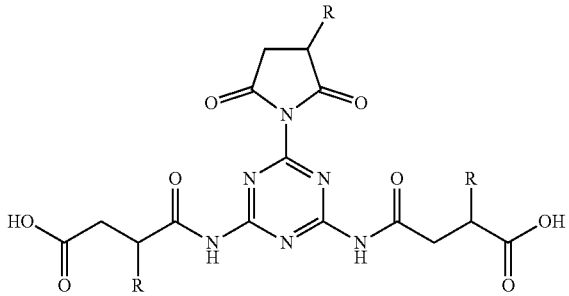

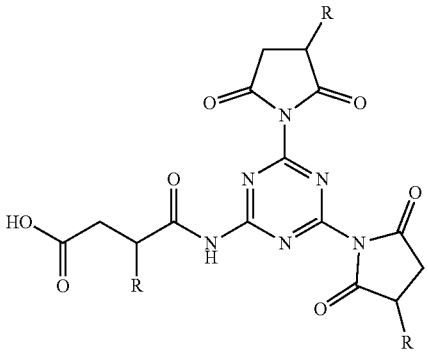

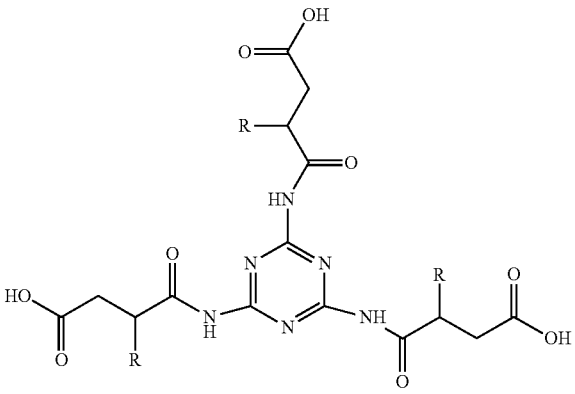

-continued

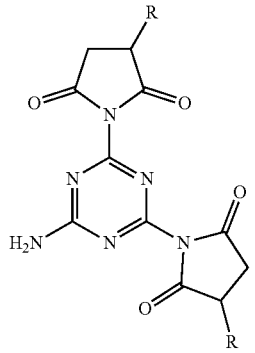

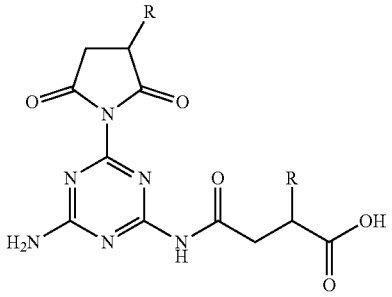

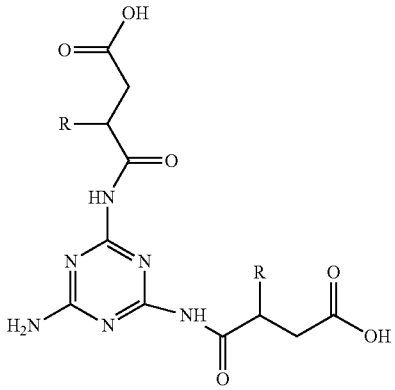

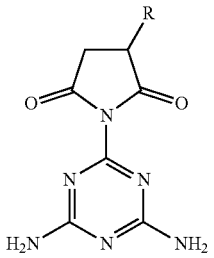

-continued

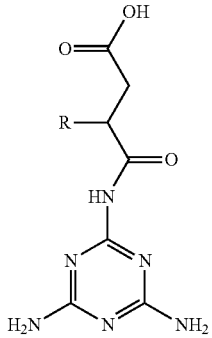

wherein each R group thereof, independently, is a C12 to C30 hydrocarbyl group; and/or wherein the lubricating composition is free of tolytriazole additives or derivatives thereof, and/or wherein the lubricating composition is free of water; and/or wherein the lubricating composition has a kV100 viscosity of about 3 to about 10 cSt; and/or wherein the lubricating composition has less than about 215 ppm of copper after testing pursuant to ASTM D130 for 168 hours at 150° C.; and/or wherein the oil-soluble hydrocarbyl-substituted melamine derivative provides about 5 to about 1100 ppm of nitrogen to the lubricating composition; and/or including about 0.01 to about 0.5 weight percent of the oil-soluble hydrocarbyl-substituted melamine derivative; and/or wherein the lubricating composition further includes less than about 1 weight percent of an alkylated diphenyl amine.

In yet another approach or embodiment, a method of lubricating a driveline component is described herein. In one aspect, the method includes lubricating a driveline component with any embodiment of the lubricating composition as described herein. In another embodiment, wherein the method includes a lubricating composition with one or more base oils of lubricating viscosity; an oil-soluble hydrocarbyl-substituted melamine derivative having the structure of Formula I (Formula I)

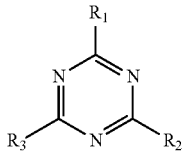

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide; and/or wherein the lubricating composition has less than about 215 ppm of copper after testing pursuant to ASTM D130 for 168 hours at 150° C.; and/or wherein the hydrocarbyl substituent of the succinimide group or the dicarboxylic acid-amide group is a C12 to C30 hydrocarbyl group; and/or wherein the oil-soluble hydrocarbyl-substituted melamine derivative is a reaction product of a hydrocarbyl-substituted succinic acid or anhydride and melamine and with a molar excess of the hydrocarbyl-substituted succinic acid or anhydride relative to the melamine; and/or wherein a molar ratio of the hydrocarbyl-substituted succinic anhydride to the melamine is about 1.1:1 to about 4:1; and/or wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group; and/or wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group; and/or wherein the lubricating composition has a kV100 viscosity of about 3 to about 10 cSt; and/or wherein the oil-soluble hydrocarbyl-substituted melamine derivative provides about 5 to about 1100 ppm of nitrogen to the lubricating composition; and/or wherein the lubricating composition includes about 0.01 to about 0.5 weight percent of the oil-soluble hydrocarbyl-substituted melamine derivative; and/or wherein the lubricating composition further includes less than about 1 weight percent of an alkylated diphenyl amine; and/or wherein the driveline is an automatic transmission.

In yet another approach or embodiment, the use of any embodiment of the corrosion inhibitor in the form of an oil-soluble hydrocarbyl-substituted melamine derivative is described herein for lubricating a drive line, and in some embodiment, for lubricating a driveline wherein the driveline lubricating composition is substantially free of tolytriazole additives or derivatives thereof and, in further embodiment, the use has less than about 215 ppm of copper after testing pursuant to ASTM D130 for 168 hours at 150° C.

Other embodiments of the present disclosure will be apparent to those skilled in the art from consideration of the specification and practice of the invention disclosed herein. The following definitions of terms are provided to clarify the meanings of certain terms as used herein.

DETAILED DESCRIPTION

In one approach, melamine-based compounds are disclosed herein that are suitable, in one embodiment, as a corrosion inhibitor for lubricating compositions and, in particular, a corrosion inhibitor for transmission fluids (e.g., manual, automatic, dual-clutch, or electric), axle fluids, differential fluids, tractor fluids, industrial gear fluids, and/or lubricating fluids for other gear-type applications. The melamine-based compounds of the present disclosure, in other approaches or embodiments, are in the form of an oil-soluble hydrocarbyl-substituted melamine derivative that, in one approach, is the reaction product of a hydrocarbyl-substituted succinic acid or anhydride (e.g., an alkenyl succinic acid or anhydride) reacted with melamine at conditions effective to form the hydrocarbyl-substituted melamine based succinimide or acid/amide compound.

In one exemplary approach or embodiment, suitable reaction conditions to form the melamine compounds herein may include a reaction temperature of about 50° C. to about 200° C. (in other approaches, about 50° C. to about 150° C. or about 100° C. to about 200° C.) and a reaction time of about 1 to about 20 hours (in other approaches, about 4 to about 16 hours, and in further approaches, about 6 to about 12 hours). The reaction conditions may also include a molar excess of the hydrocarbyl-substituted succinic acid or anhydride reactant (e.g., the alkenyl succinic acid or anhydride) relative to the melamine reactant. Suitable hydrocarbyl-substituted succinic acid or anhydride reactants may include, for example, C12 to C30 alkenyl succinic acids or anhydrides (preferably C12 to C24 alkenyl succinic acids or anhydrides, or most preferably C12 to C16 alkenyl succinic acids or anhydrides) and, more specifically, suitable reactants include, but are not limited to, C20-C24 alpha olefins reacted with maleic acid or anhydride, hexadecenyl succinic acid or anhydride, dodecenyl succinic acid or anhydride, combinations thereof, and the like hydrocarbyl succinic acids or anhydrides. In yet other approaches, the hydrocarbyl-substituted succinic acid or anhydride reactants may also be tetrapropenyl alkenyl succinic acid or anhydride, n-dodecyl alkenyl succinic acids or anhydrides. In yet alternative approaches, polyisobutylene-substituted acids or anhydrides (e.g., PIBSA) may also be suitable as a starting reactant and, preferably, polyisobutylenes having a number average molecular weight of up to about 450, in other approaches, up to about 1000, or up to about 1500, or up to about 2500 (or any ranges therebetween).

In one approach or embodiment, the oil-soluble hydrocarbyl-substituted melamine derivatives of the present disclosure suitable for the corrosion inhibitor have a structure of Formula I (Formula I)

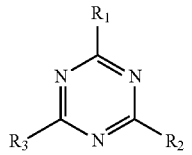

wherein each of $R_1$, $R_2$, and $R_3$ is, independently, —$NH_2$, a hydrocarbyl-substituted succinimide group (i.e., Formula II below), or a hydrocarbyl-substituted dicarboxylic acid-amide group (i.e. Formula III below). In one approach, one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and/or $R_3$ is the —$NH_2$ group or the hydrocarbyl-substituted dicarboxylic acid-amide group. In another approach, one or two of $R_1$, $R_2$, and $R_3$ is, independently, the hydrocarbyl-substituted succinimide group and the remaining $R_1$, $R_2$, and/or $R_3$ is the hydrocarbyl-substituted dicarboxylic acid-amide group. The hydrocarbyl-substituted succinimide group may have the structure of Formula II and the hydrocarbyl-substituted dicarboxylic acid-amide group may have the structure of Formula III (with the ~ representing the bond to the central melamine moiety):

(Formula II)

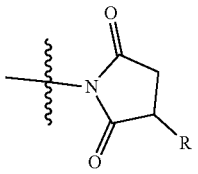

(Formula III)

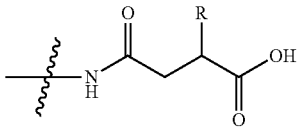

In other approaches, one of $R_1$, $R_2$, and $R_3$ is, independently, either the hydrocarbyl-substituted succinimide group or the hydrocarbyl-substituted dicarboxylic acid-amide group, and in further approaches, two of $R_1$, $R_2$, and $R_3$ are, independently, either the hydrocarbyl-substituted succinimide group or the hydrocarbyl-substituted dicarboxylic acid-amide group. In either instance, the remaining $R_1$, $R_2$, and $R_3$ groups is either the hydrocarbyl-substituted dicarboxylic acid-amide group or the —$NH_2$ group and, preferably, the —$NH_2$ group. In yet further approaches or embodiments, the hydrocarbyl substituent (e.g., the hydrocarbyl group of the $R_1$, $R_2$, and/or $R_3$ moieties (that is, the R group of Formula II or III above) is a C12 to C30 hydrocarbyl group, preferably the hydrocarbyl substituent is a C12 to a C24 hydrocarbyl group, and most preferably a C12 hydrocarbyl group, a C16 hydrocarbyl group, a C20 hydrocarbyl group, a C24 hydrocarbyl group, or any mixtures thereof.

As mentioned above, the oil-soluble hydrocarbyl-substituted melamine derivatives herein may be prepared in a reaction having a molar excess of the hydrocarbyl-substituted succinimide acid or anhydride reactant relative to the melamine reactant. In one embodiment, this molar excess is reflected in a molar ratio of the hydrocarbyl-substituted succinic acid or anhydride reactant to the melamine reactant of about 1.1:1 to about 4:1, and in another embodiment, the molar ratio of the hydrocarbyl-substituted succinic acid or anhydride reactant to the melamine reactant is about 1.1:1 to about 3:1, and in a further embodiment, the molar ratio is about 2.0:1 to about 3.0:1.

When the melamine derivatives herein are formed in a reaction at the above conditions and with the molar excess of the hydrocarbyl-substituted succinic anhydride, the resultant melamine derivative has about 5 to about 25 weight percent nitrogen and, with a treat rate of about 0.01 to about 0.5 weight percent in a fluid, capable of providing about 5 ppm to about 1100 ppm nitrogen, about 10 to about 800 ppm nitrogen, about 10 to about 200 ppm nitrogen, about 25 to about 100 ppm of nitrogen, and preferably about 25 to about 80 ppm of nitrogen to a lubricant, and more preferably, about 30 to about 75 ppm of nitrogen to a lubricant. In other embodiments, the oil-soluble hydrocarbyl-substituted melamine derivative formed in a reaction at the above conditions and with the molar excess of the hydrocarbyl-substituted succinic anhydride has one or more of the following structures:

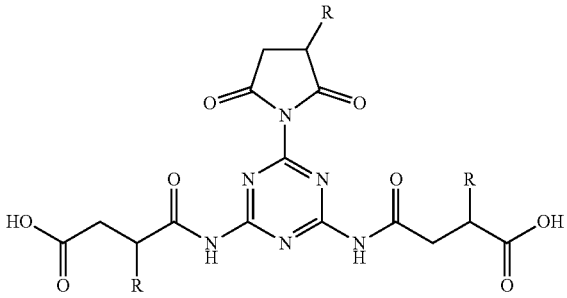

-continued

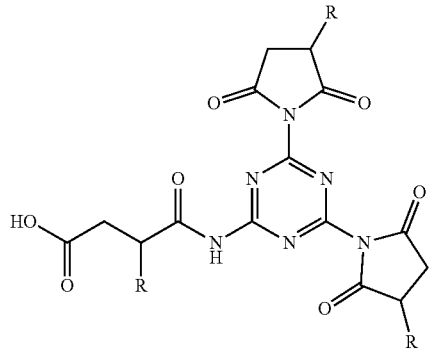

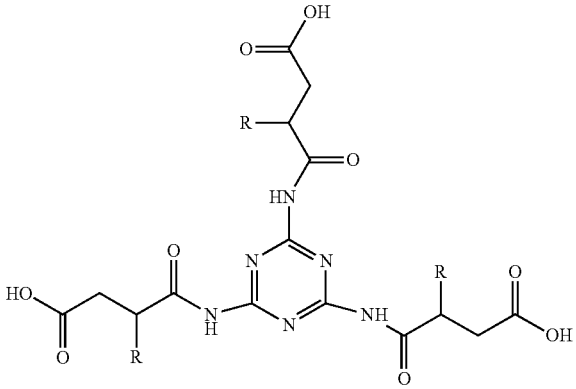

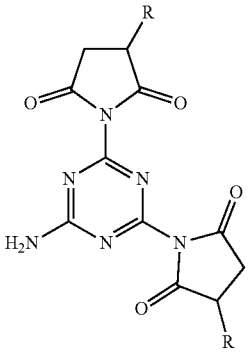

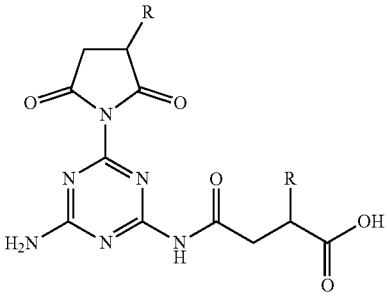

-continued

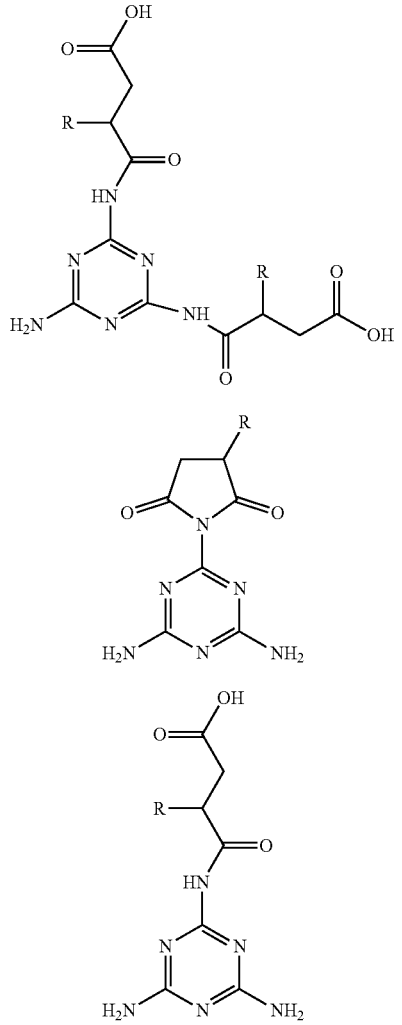

wherein each R group thereof is the hydrocarbyl substituent discussed above and, independently, is a C12 to C30 hydrocarbyl group, preferably a C12 to a C24 hydrocarbyl group, and most preferably a C12 hydrocarbyl group, a C16 hydrocarbyl group, a C20 hydrocarbyl group, a C24 hydrocarbyl group, or any mixtures thereof As noted above, the melamine derivatives herein are particularly suited as corrosion inhibitors in lubricants, and in particular, corrosion inhibitors for lubricating compositions suitable for transmission fluids (manual, automatic, dual-clutch, or electric), axle fluids, differential fluids, tractor fluids, industrial gear fluids, and/or lubricating fluids for other gear-type applications and to such lubricating compositions including the melamine-based corrosion inhibitor. In one approach or embodiment, such lubricating compositions may include about 0.01 to about 0.5 weight percent of the melamine derivatives herein (preferably, about 0.02 to about 0.1 weight percent, and more preferably, about 0.03 to about 0.08 weight percent). With this melamine derivative, the lubricating compositions herein may exhibit less than about 215 ppm of copper leaching after testing pursuant to a modified version of ASTM D130 for 168 hours at 150° C. (preferably, less than 100 ppm of copper, more preferably, less than about 80 ppm of copper). The compositions herein with such amounts of the melamine derivatives may also exhibit a copper tarnishing rating of 4a to 4b. Most surprisingly, the lubricating compositions herein can achieve such low copper leaching levels and tarnishing ratings in compositions that are substantially free of prior tolyltriazole additives, which means the compositions herein have less than 0.1 weight percent of tolyltriazole additives, less than about 0.05 weight percent of tolyltriazole additives, less than about 0.01 weight percent of tolyltriazole additives, or preferably no functional amounts and/or no detectable amounts of tolyltriazole additives.

The lubricating compositions herein may include the melamine-based corrosion inhibitor discussed above combined with other additives suitable for the lubricant applications noted above. This additional additives may include one or more of phosphorus antiwear additives, sulfur antiwear additives, antioxidants (including aminic antioxidants), viscosity modifiers, and a synthetic or mineral base oil to provide, in some embodiments, a kV100 viscosity (ASTM D445) of about 3 to about 10 cSt. Preferably, the lubricants have de minimis levels of water (e.g., about 0.5 weight percent or less, about 0.1 weight percent or less, or 0.05 weight percent or less) and, preferably, free of water or no detectable levels of water.

Base Oil

Suitable base oils for use in the lubricating composition according to the disclosure may be a mineral oil, animal oil, vegetable oil, synthetic oil, or mixtures thereof.

Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Mineral oils may include oils obtained by drilling or from plants and animals or any mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The base oil or base oil of lubricating viscosity used in the compositions herein may be a single base oil or may be a mixture of two or more base oils. The one or more base oil may be selected from any of the base oils in Groups I-V as specified in the American Petroleum Institute (API) Base Oil Interchangeability Guidelines. These base oil groups are as follows:

TABLE 1

Base oil Types

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | ≥90 | 80 to 120 |
| Group III | <0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain synthetic molecular species, which are produced by polymerization of olefinically unsaturated hydrocarbons. API Group IV base oils, polyalphaolefins (PAOs), are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Suitable PAO viscosity examples include 4 cSt at 100° C. and 6 cSt at 100° C., and mixtures thereof. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

The base oil(s) are combined with an additive composition as disclosed in embodiments herein to provide a lubricating fluid for transmissions, axles, tractors, or industrial gears. Accordingly, the base oil may be present in the lubricating fluid in an amount greater than about 80 wt % based on the total weight of the lubricating fluid. In some embodiments, the base oil may be present in the lubricating fluid in an amount greater than about 85 wt % based on the total weight of the lubricating fluid and may be selected from any of suitable synthetic or natural oils or mixtures thereof having a suitable lubricating viscosity.

A suitable transmission, axle, differential, tractor, or industrial gear lubricant composition herein may include additive components in the ranges listed in the Table 2.

TABLE 2

Suitable Driveline or Gear Fluid Compositions

| Component | wt % (Suitable Embodiments) |
|---|---|
| Melamine Corrosion Inhibitor | 0.01-0.5 |
| Antioxidant(s) | 0.1-3.0 |
| Detergent(s) | 0.0-2.0 |
| Antiwear Agents(s) | 0.0-5.0 |
| Antifoaming agent(s) | 0.0-0.1 |
| Pour point depressant(s) | 0.0-0.5 |
| Viscosity index improver(s) | 0.0-10.0 |
| Dispersants | 0.0-8.0 |
| Friction modifier(s) | 0.0-1.0 |
| Diluent and Demulsifiers | 0-2.0 |
| Base oil(s) | Balance |
| Total | 100 |

The percentages of each component above represent the weight percent of each component, based upon the weight of the total lubricating oil composition. The balance of the lubricating oil composition consists of one or more base oils. Additives used in formulating the compositions described herein may be blended into the base oil individually or in various sub-combinations. However, it may be suitable to blend all the components concurrently using an additive concentrate (i.e., additives plus a diluent, such as a hydrocarbon solvent).

The lubricating composition described herein may be formulated to provide lubrication, adequate load carrying capacity, and improved copper corrosion for various applications. Lubricating fluids according to the present disclosure can be used in transmission fluids, axle fluids, differential fluids, tractor fluids, industrial gear fluids, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 5 wt %, or about 0.01 wt % to about 4 wt %, or about 0.05 wt % to about 3 wt %, or about 0.1 wt % to about 3 wt % of the lubricating oil composition. The phosphorus-containing compound may provide up to 500 ppm phosphorus, or from about 3 to about 100 ppm phosphorus, or from about 4 to about 20 ppm phosphorus, or up to 50 ppm phosphorus, or up to 20 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 4 to about 8 weight percent phosphorus, or about 5 to about 6 weight percent phosphorus.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may have the formula:

(Formula XIV)

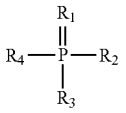

wherein $R_1$ is S or O; $R_2$ is —OR, —OH, or —R"; $R_3$ is —OR", —OH, or SR'"C(O)OH; $R_4$ is —OR"; R'" is C1 to $C_3$ branched or linear alkyl chain; and R" is a $C_1$ to $C_{18}$ hydrocarbyl chain. When the phosphorous-containing compound has the structure shown in Formula XIV, the compound may have about 8 to about 16 weight percent phosphorus.

In some embodiments, the lubricating composition comprises a phosphorus-containing compound of Formula XIV wherein $R_1$ is 0; $R_2$ is H; $R_3$ and $R_4$ are each OR" wherein R" is $C_{18}$; wherein the phosphorus-containing compound is present in an amount to deliver between 3-50 ppm phosphorus or between 3-20 ppm phosphorus to the lubricating composition. In other embodiments, the lubricating composition comprises a phosphorus-containing compound of Formula XIV wherein $R_1$ is 0; $R_2$ is H; $R_3$ and $R_4$ are each OR" wherein R" is oleyl; and wherein the phosphorus-containing compound is present in an amount to deliver between 3-50 ppm phosphorus or between 3-20 ppm phosphorus to the lubricating composition.

In some embodiments the lubricant composition comprises a phosphorus-containing compound of Formula XIV wherein $R_1$ is S; $R_2$ is —OR"; $R_3$ is S R'"COOH; $R_4$ is —OR"; R'" is $C_3$ branched alkyl chain; R" is $C_4$; and wherein the phosphorus-containing compound is present in an amount to deliver between 3-50 ppm phosphorus to the lubricant composition.

In another embodiment, the lubricant composition comprises a phosphorus-containing compound of Formula XIV wherein $R_1$ is 0; $R_2$ is —OH; $R_3$ is —OR" or —OH; $R_4$ is —OR"; R" is $C_5$; and wherein phosphorus-containing compound is present in an amount to deliver between 3-50 ppm phosphorus to the lubricant composition.

In yet another embodiment, the lubricant composition comprises a phosphorus-containing compound of Formula XIV wherein $R_1$ is 0; $R_2$ is OR"; $R_3$ is H; $R_4$ is —OR"; R" is $C_4$; and wherein the one or more phosphorus-containing compound(s) is present in an amount to deliver between 3-50 ppm phosphorus to the lubricant composition.

In other embodiments, the lubricant composition comprises a phosphorus-containing compound of Formula XIV wherein $R_1$ is 0; $R_2$ is —R"; $R_3$ is —$OCH_3$ or —OH; $R_4$ is —$OCH_3$; R" is Cis; and wherein the one or more phosphorus-containing compound(s) is present in an amount to deliver between 3-50 ppm phosphorus to the lubricant composition.

Anti-Wear Agents

The lubricant composition may also include anti-wear agents that are non-phosphorus-containing compounds. Examples of such antiwear agents include borate esters, borate epoxides, thiocarbamate compounds (including thiocarbamate esters, alkylene-coupled thiocarbamates, and bis (S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 5 wt %, or about 0.01 wt % to about 4 wt %, or about 0.05 wt % to about 3 wt %, or about 0.1 wt % to about 3 wt % of the lubricating oil composition.

Sulfur Containing Compounds

The lubricant compositions of the disclosure may also contain sulfur containing compounds provided for extreme pressure performance so long as the lubricating compositions herein include the noted amounts and profiles set forth herein.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550;

4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576).

One suitable class of extreme pressure agents are polysulfides composed of one or more compounds represented by the formula: Ra—$S_x$—Rb where Ra and Rb are hydrocarbyl groups each of which may contain 1 to 18, and in other approaches, 3 to 18 carbon atoms and x may be from 2 to 8, and typically from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an "adduct," in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

One particularly useful antioxidant includes nonyl diphenylamine and di-nonyl diphenylamine. In an embodiment, the lubricating oil composition may contain one or more of these diphenylamines present in an amount up to about 1 wt %.

The one or more antioxidant(s) may be present in ranges about 0 wt % to about 3 wt %, or about 0.1 wt % to about 1 wt %, or about 0.1 wt % to about 0.5 wt %, of the lubricating oil composition.

Dispersants

The lubricant composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. N-substituted long chain alkenyl succinimides include polyisobutylene (PIB) substituents with a number average molecular weight of the polyisobutylene substituent in a range of about 800 to about 2500 as determined by gel permeation chromatograph (GPC) using polystyrene (with a number average molecular weight of 180 to about 18,000) as the calibration reference. The PIB substituent used in the dispersant typically has a viscosity at 100° C. of about 2100 to about 2700 cSt as determined using ASTM D445-18. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetraethylenepentaamine (TEPA), triethylenetetraamine (TETA), pentaethylenehexaamine (PEHA), other higher nitrogen ethylene diamine species and/or mixtures thereof. The polyamines may be mixtures of linear, branched and cyclic amines. The PIB substituents may be joined to each succinimide moiety.

In some embodiments the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, PIB, when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR—PIB"). HR—PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR—PIB having a number average molecular weight ranging from about 900 to about 3000, as measured by the GPC method described above, may be suitable. Such an HR—PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR—PIB may lead to higher conversion rates in the reaction, as well as lower amounts of sediment formation, due to increased reactivity.

In some embodiments the lubricant composition comprises at least one dispersant derived from polyisobutylene succinic anhydride. In some embodiments, the dispersant may be derived from a polyalphaolefin (PAO) succinic anhydride.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride nitriles, epoxides, carbonates, cyclic carbonates, hindered phenolic esters, and phosphorus compounds. U.S. Pat. Nos. 7,645,726; 7,214,649; and 8,048,831 describes some suitable post-treatment methods and post-treated products.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron-trifluoride-phenol, boron-trifluoride-phosphoric acid, boron-trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, thiophosphorous acid; dithiophosphorous acid and trithiophosphorous acid; the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($HLP_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3P_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable are the inorganic phosphorus halide compounds such as $PCl_3$, $PBr_3$, $POCl_3$, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment the lubricating oil composition may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m—[NH(CH_2)_m]_n—NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° C. to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 1400 to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 4.5 to about 10 weight percent and, in other approaches, about 4.5 to about 8 weight percent, and in yet other approaches, about 4.5 to about 7.7 weight percent in the lubricant.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 10 wt %, about 0.1 wt % to about 8 wt %, about 0.1 wt % to about 6 wt % of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oils will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission (manual, automatic, dual-clutch, or electric) and/or a gear differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %" or "weight percent", unless expressly stated otherwise, means the percentage the recited component represents to the weight of the entire composition. All percent numbers herein, unless specified otherwise, is weight percent. As used herein, free—of means less than about 0.1 weight percent, less than about 0.05 weight percent, less than about 0.01 weight percent, or no functional amounts of such component.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PL gel columns (length of 300×7.5 mm; particle size of 5μ, and pore size ranging from 100-10000 Å) with the column temperature at about 40° C. Un-stabilized IPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

Oil-soluble hydrocarbyl-substituted melamine derivatives were prepared by dissolving an alkenyl succinic anhydride (ASA, e.g., Table 3 below) in dimethyl sulfoxide at about 100° C., adding melamine at about 100° C., and then stirring the reaction mixtures for about 5 hours. Thereafter, ice water was added to the mixture, a brown precipitate was collected, which was then dissolved in tert-butyl methyl ether, filtered, and then concentrated in a rotary evaporator. The concentrated samples were then dried in a 75° C. oven overnight to yield a viscous, brown liquid. The alkenyl succinic anhydride (ASA) reactants used in this Example are set forth in Table 3 below and reaction conditions with the melamine are set forth in Table 4 below.

TABLE 3

| Alkenyl Succinic Anhydride (ASA) Reactants | |
|---|---|
| ASA | Description |
| A | $C_{20-24}$ alpha olefin mixture reacted with maleic anhydride (estimated at 400 g/mol) |
| B | Hexadecenyl (C16) succinic anhydride (322.5 g/mol) |
| C | Dodecenyl (C12) succinic anhydride (266.38 g/mol) |

TABLE 4

| Reaction Conditions | | |
|---|---|---|
| Reaction Product | ASA | Molar ratio of ASA:Melamine |
| 1 | A | 2.2:1 |
| 2 | B | 2.5:1 |
| 3 | C | 1.1:1 |
| 4 | C | 3.0:1 |

Example 2

Lubricants including the Reaction Products of Table 4 from Example 1 were prepared and evaluated for extended copper corrosion pursuant to ASTM D130 (168 hours at 150° C.). Each Inventive lubricant of this Example included about 0.035 weight percent of one of the Reaction Products of Table 4 from Example 1 and identical amounts of the same additive package (e.g., dispersant, antifoam, friction modifiers, antioxidants, detergent, and antiwear agents), a viscosity modifier, and a Group III base oil to form Inventive transmission lubricants 1-4 having a kV100 of about 5 cSt (ASTM D445). The Inventive lubricants are identified in Table 5 below along with the results of extended copper corrosion tests of ASTM D130 (e.g., visual copper tarnishing and copper leaching). A Comparative lubricant including the same amounts of and the same additive package, viscosity modifier, and Group III base oil but no corrosion inhibitor was also tested for extended copper corrosion and shown in Table 5 below for comparison.

TABLE 5

| | Comparative 1 | Inventive 1 | Inventive 2 | Inventive 3 | Inventive 4 |
|---|---|---|---|---|---|
| Reaction product 1 (wt %) | — | 0.035 | — | — | — |
| Reaction Product 2 (wt %) | — | — | 0.035 | | — |
| Reaction Product 3 (wt %) | — | — | — | 0.037 | — |
| Reaction Product 4 (wt %) | — | — | — | — | 0.035 |
| N ppm from Reaction Product (calculated) | N/A | 26.65 | 33.32 | 73.29 | 33.32 |
| Ratio of ASA:melamine | N/A | 2.2 | 2.5 | 1.1 | 3.0 |
| P, ppm (measured by ICP) | 293 | 282 | 282 | 271 | 284 |
| Visual Rating | 4b | 4a | 4b | 4a | 4a |
| Cu, ppm | 59 | 30 | 29 | 32 | 32 |

As shown in Table 5 above, the Inventive Lubricants including the melamine derivatives of the present disclosure exhibited comparable or better copper tarnishing and lower copper leaching than the comparison lubricant. The lubricants of this example did not include any tolyltriazole additives or derivatives thereof.

Example 3

Additional Inventive lubricants including the Reaction Products of Table 4 from Example 1 were prepared and evaluated for extended copper corrosion pursuant to ASTM D130 (168 hours at 150° C.) as in Example 2. Each Inventive lubricant of this Example included about 0.035 weight percent of one of the Reaction Products of Table 4 from Example 1 and identical amounts of the same additive package (including dispersant, antifoam, friction modifiers, antioxidants, detergent, and antiwear agents), a viscosity modifier, and a Group III base oil to form Inventive transmission lubricants 5-8 having a kV100 of about 5 cSt (ASTM D445). The Inventive lubricants of this Example are identified in Table 6 below along with the results of the extended copper corrosion tests of ASTM D130 (e.g., visual copper tarnishing and copper leaching). A Comparative lubricant including the same amounts of and the same additive package, viscosity modifier, and Groups III base oil but no corrosion inhibitor was also tested for extended copper corrosion and shown in Table 6 below for comparison.

TABLE 6

| | Comparative 2 | Inventive 5 | Inventive 6 | Inventive 7 | Inventive 8 |
|---|---|---|---|---|---|
| Reaction product 1 (wt %) | — | 0.035 | — | — | — |
| Reaction Product 2 (wt %) | — | — | 0.035 | — | — |
| Reaction Product 3 (wt %) | — | — | — | 0.037 | — |
| Reaction Product 4 (wt %) | — | — | — | — | 0.035 |
| N ppm from Reaction Product | N/A | 26.65 | 33.32 | 73.29 | 33.32 |
| Ratio of ASA:melamine | N/A | 2.2 | 2.5 | 1.1 | 3.0 |
| P, ppm (measured by ICP) | 142 | 139 | 138 | 139 | 139 |
| Visual Rating | 4c | 4b | 4a | 4a | 4a |
| Cu, ppm | 114 | 71 | 61 | 67 | 66 |

As shown in Table 6 above, the Inventive Lubricants including the melamine derivatives of the present disclosure exhibited comparable or better copper tarnishing and lower copper leaching than the comparison lubricant. The lubricants of this example also did not include any tolyltriazole additives or derivatives thereof.

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A corrosion inhibitor in the form of an oil-soluble hydrocarbyl-substituted melamine derivative having the structure of Formula I (Formula I)

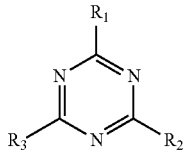

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide.

2. The corrosion inhibitor of claim 1, wherein the hydrocarbyl substituent of the succinimide group or the dicarboxylic acid-amide group is a C12 to C30 hydrocarbyl group.

3. The corrosion inhibitor of claim 2, wherein the hydrocarbyl substituent of the succinimide group or the dicarboxylic acid-amide group is a C12 to a C24 hydrocarbyl group.

4. The corrosion inhibitor of claim 1, wherein the corrosion inhibitor has about 5 weight percent to about 25 weight percent of nitrogen.

5. The corrosion inhibitor of claim 1, wherein the corrosion inhibitor is a reaction product of a hydrocarbyl-substituted succinic acid or anhydride and melamine and with a molar excess of the hydrocarbyl-substituted succinic acid or anhydride relative to the melamine.

6. The corrosion inhibitor of claim 5, wherein a molar ratio of the hydrocarbyl-substituted succinic acid or anhydride to the melamine is about 1.1:1 to about 4:1.

7. The corrosion inhibitor of claim 5, wherein a molar ratio of the hydrocarbyl-substituted succinic acid or anhydride to the melamine is about 1.1:1 to about 3:1.

8. The corrosion inhibitor of claim 1, wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group.

9. The corrosion inhibitor of claim 7, wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group.

10. The corrosion inhibitor of claim 1, wherein the oil-soluble hydrocarbyl-substituted melamine derivative has one or more of the following structures

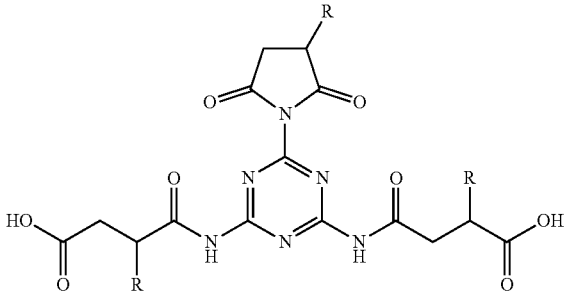

-continued

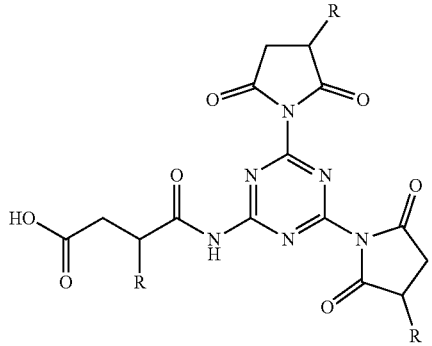

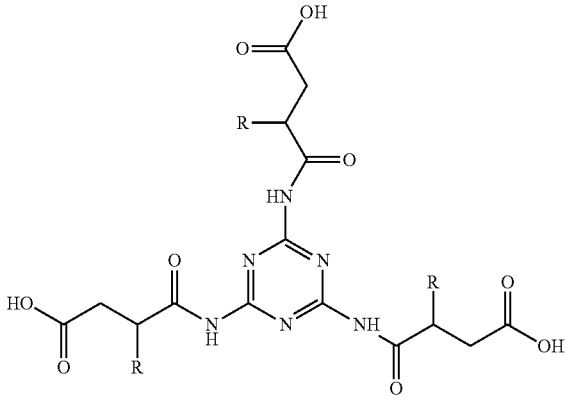

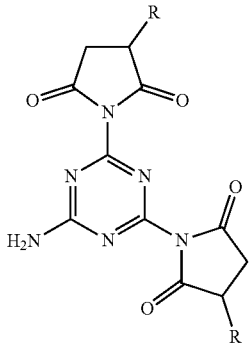

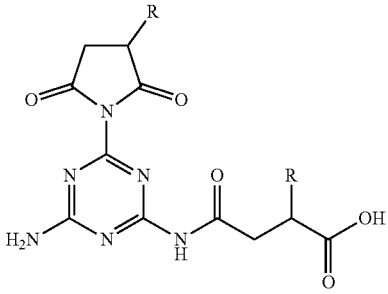

-continued

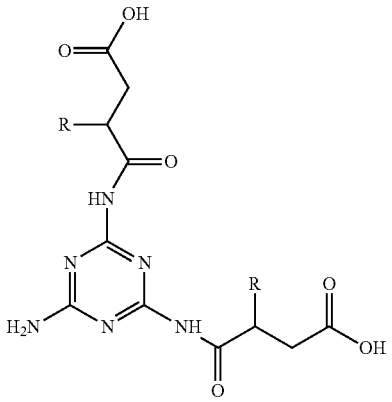

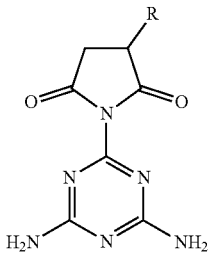

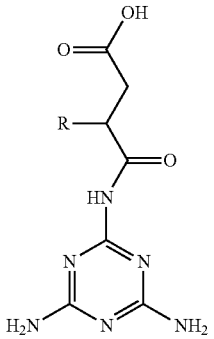

wherein each R group thereof, independently, is a C12 to C30 hydrocarbyl group.

11. The corrosion inhibitor of claim 1, wherein a lubricating composition including about 0.1 to about 0.5 weight percent of the corrosion inhibitor exhibits less than about 100 ppm of copper after testing pursuant to ASTM D130 for 168 hours at 150° C.

12. A method of preparing an oil-soluble hydrocarbyl-substituted melamine derivative corrosion inhibitor comprising reacting a hydrocarbyl-substituted succinic acid or anhydride with melamine and with a molar excess of the hydrocarbyl-substituted succinic acid or anhydride relative to the melamine.

13. The method of claim 12, wherein the hydrocarbyl substituent is a C12 to C30 hydrocarbyl group.

14. The method of claim 13, wherein the hydrocarbyl substituent is a C12 to a C24 hydrocarbyl group.

15. The method of claim 12, wherein a molar ratio of the hydrocarbyl-substituted succinic acid or anhydride to the melamine is about 1.1:1 to about 4:1.

16. The method of claim 12, wherein a molar ratio of the hydrocarbyl-substituted succinic acid or anhydride to the melamine is about 1.1:1 to about 3:1.

17. The method of claim 12, wherein the formed corrosion inhibitor has about 5 to about 25 weight percent of nitrogen.

18. The method of claim 12, wherein the formed oil-soluble hydrocarbyl-substituted melamine derivative has the structure of Formula I (Formula I)

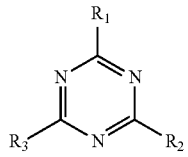

wherein each of $R_1$, $R_2$, and $R_3$ is, independently, —$NH_2$, a hydrocarbyl-substituted succinimide group, or a hydrocarbyl-substituted dicarboxylic acid-amide group, and wherein one or two of $R_1$, $R_2$, and $R_3$ is, independently, either the hydrocarbyl-substituted succinimide group or the hydrocarbyl-substituted dicarboxylic acid-amide group and the remaining $R_1$, $R_2$, and $R_3$ is, independently, either the —$NH_2$ or the hydrocarbyl-substituted dicarboxylic acid-amide.

19. The method of claim 18, wherein one of $R_1$, $R_2$, and $R_3$ is, independently, either the hydrocarbyl-substituted succinimide group or the hydrocarbyl-substituted dicarboxylic acid-amine group and the remaining two of $R_1$, $R_2$, and $R_3$ are the —$NH_2$ group.

20. The method of claim 18, wherein two of $R_1$, $R_2$, and $R_3$ are, independently, either the hydrocarbyl-substituted succinimide group or the hydrocarbyl-substituted dicarboxylic acid-amine group and the remaining one of $R_1$, $R_2$, and $R_3$ is the —$NH_2$ group.

21. The method of claim 18, wherein the oil-soluble hydrocarbyl-substituted melamine derivative has one or more of the following structures

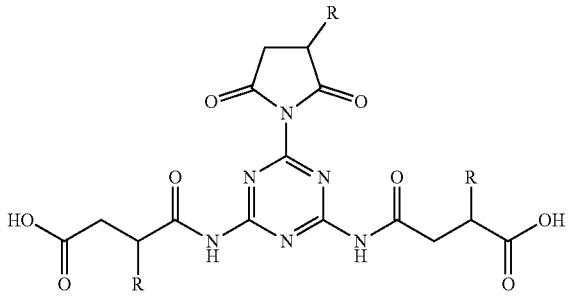

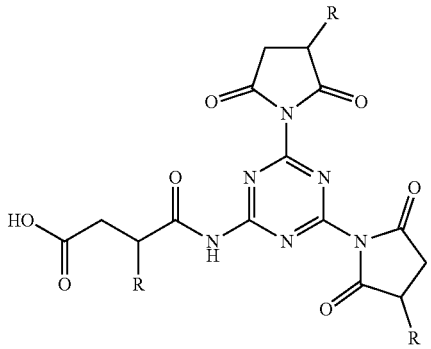

-continued
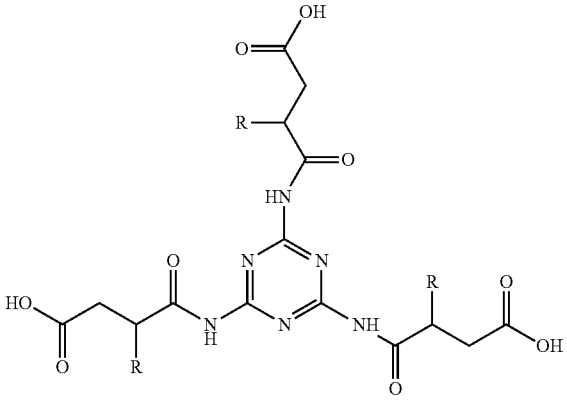
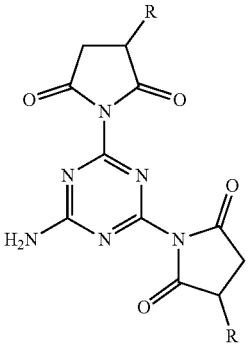
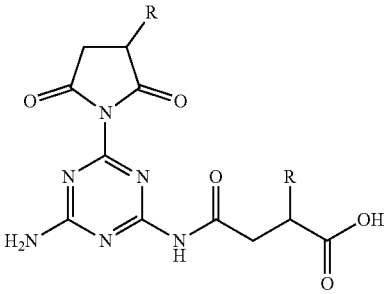
-continued
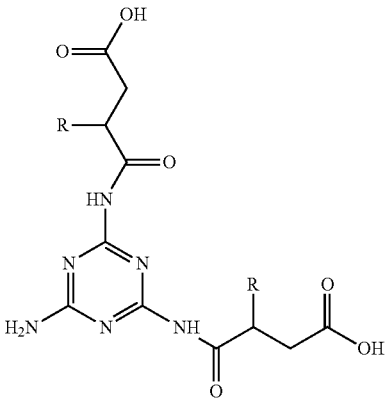
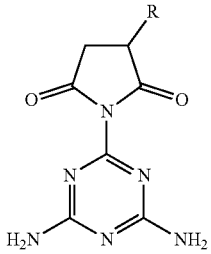
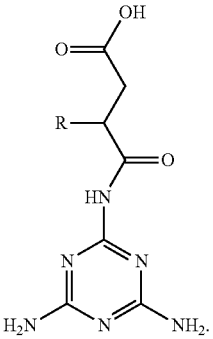
* * * * *